United States Patent [19]

Canfield et al.

[11] 4,080,022

[45] Mar. 21, 1978

[54] MULTIPLE STATION SERVICE COUNTER

[76] Inventors: Vernon C. Canfield, Rte. 7, P. O. Box 7291, Bainbridge Island, Wash. 98110; Charles F. Anderson, 1265 Old Mill Rd., San Marino, Calif. 91108

[21] Appl. No.: 718,945

[22] Filed: Aug. 30, 1976

[51] Int. Cl.[2] ..... A47B 53/00

[52] U.S. Cl. ..... 312/239; 312/140.1; 312/198; 108/64

[58] Field of Search ..... 312/239, 140.1, 196, 312/198, 203; 108/64

[56] References Cited

U.S. PATENT DOCUMENTS

| | | | |
|---|---|---|---|
| 1,308,441 | 7/1919 | Myers | 312/198 |
| 2,401,226 | 5/1946 | Calvert | 312/239 |
| 2,688,525 | 9/1954 | Lindstrom | 312/140.1 |
| 3,124,398 | 3/1964 | Fuller et al. | 312/198 |
| 3,202,468 | 8/1965 | Kegel | 312/140.1 |
| 3,267,881 | 8/1966 | Saggione | 108/64 |
| 3,366,415 | 1/1968 | Cooper | 312/239 |
| 3,696,760 | 10/1972 | Riley | 312/239 |

FOREIGN PATENT DOCUMENTS

| | | | |
|---|---|---|---|
| 116,737 | 4/1943 | Australia | 312/140.1 |
| 144,705 | 11/1901 | Germany | 312/196 |
| 122,424 | 8/1948 | Sweden | 108/64 |

*Primary Examiner*—Paul R. Gilliam
*Assistant Examiner*—Victor N. Sakran
*Attorney, Agent, or Firm*—Seed, Berry, Vernon & Baynham

[57] ABSTRACT

A service counter having several spaced apart service stations each of which allows a single person to service two customers. Each service station includes a pair of customer windows facing a common service person workspace positioned therebetween so that the person is equally accessible to both customer windows, yet adjacent customer windows at different service stations face away from each other to insure privacy. The service counter maximizes equipment efficiency by utilizing a single unit of relatively expensive equipment for two customer windows, and it maximizes the efficiency of service personnel by allowing a person to service one customer while another customer at the same service station is preparing to do business with the service person.

10 Claims, 4 Drawing Figures

MULTIPLE STATION SERVICE COUNTER

BACKGROUND OF THE INVENTION

1. Field of the Invention

This invention relates to service counters and more particularly, to an improved service counter which allows a single service person to simultaneously service two customers at a single service station.

2. Description of the Prior Art

In many businesses and industries individual service personnel positioned behind a counter are responsible for servicing several customers. For example, in the banking, sports events, credit and food service industries. In such installations customers sit or stand on one side of a counter while a service person works on the other side of the counter. Conventional teller lines for banks generally include a large number of teller stations arranged in a row. A teller is stationed at each teller station, and each teller station includes a single customer window. As a consequence of this structure, a single teller can only service one customer at a time and, as is often the case, a banking customer arrives at the customer window unprepared to complete his or her banking transaction. Under such circumstances, the teller stands idle while the customer prepares a document for the banking transaction. The amount of time that a teller is idle greatly reduces teller efficiency.

The equipment efficiency inherent in the structure of conventional teller windows is also relatively low since the equipment at each teller station, as well as the teller, is idle during the time that the customer is preparing for a banking transaction. Much of the equipment at a teller line, particularly teller machines, are expensive and the capital and maintenance expenses of such machines being idle materially increases the cost of banking services.

The teller stations of most conventional teller lines are arranged in a continuous, linear row so that the customer windows of adjacent teller stations are closely spaced apart from each other. As a result, a customer at a teller station normally has relatively little privacy from the customers at adjacent teller stations who are easily able to view the nature and amount of the customer's banking transaction.

SUMMARY OF THE INVENTION

It is an object of the invention to provide a service counter having a plurality of service stations each of which includes a single unit of relatively expensive equipment serving two customer windows thereby increasing the utilization of such relatively expensive equipment.

It is another object of the invention to provide a service counter which allows a person to service one customer while another customer at the same service station is preparing for or completing a transaction.

It is still another object of the invention to provide a service counter which provides a customer with a substantially improved degree of privacy during a transaction.

These and other objects of the present invention are accomplished by a service counter having a plurality of service stations, each of which includes a pair of customer service areas equally accessible to a person. In the preferred embodiment of the invention, the service areas for each service station face inwardly toward a service person so that adjacent service areas for adjacent service stations face away from each other thereby providing privacy for a customer during a transaction. In one embodiment of the service counter, each service station includes specified equipment.

DETAILED DESCRIPTION OF THE INVENTION

Figure 2:
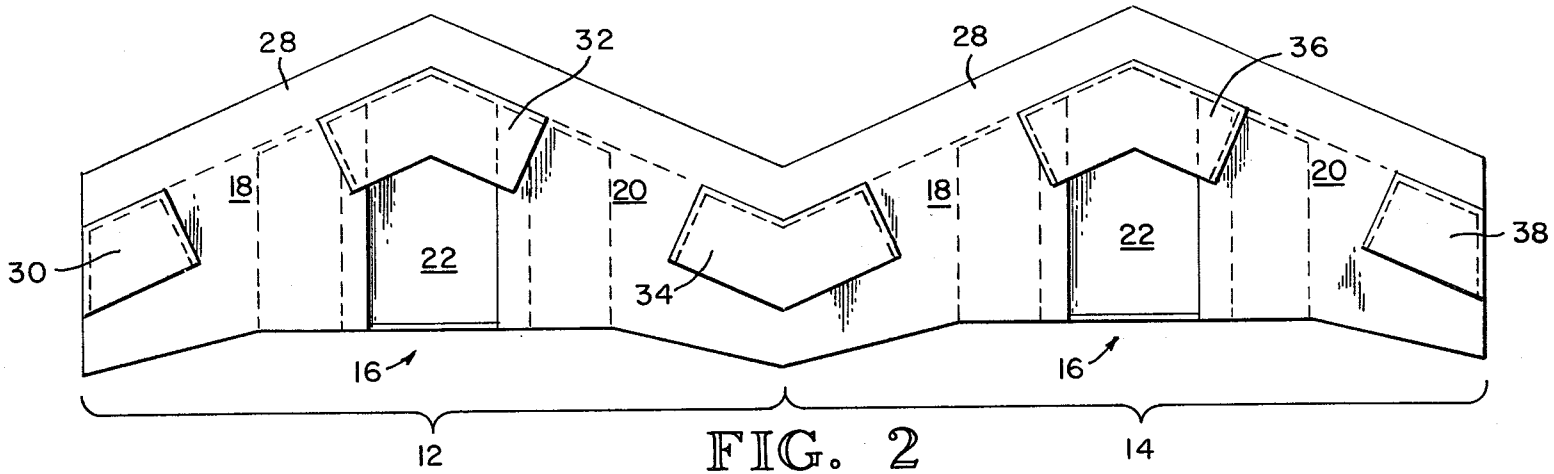
FIG. 2 is a top plan view of the service counter of FIG. 1.
Figure 1:
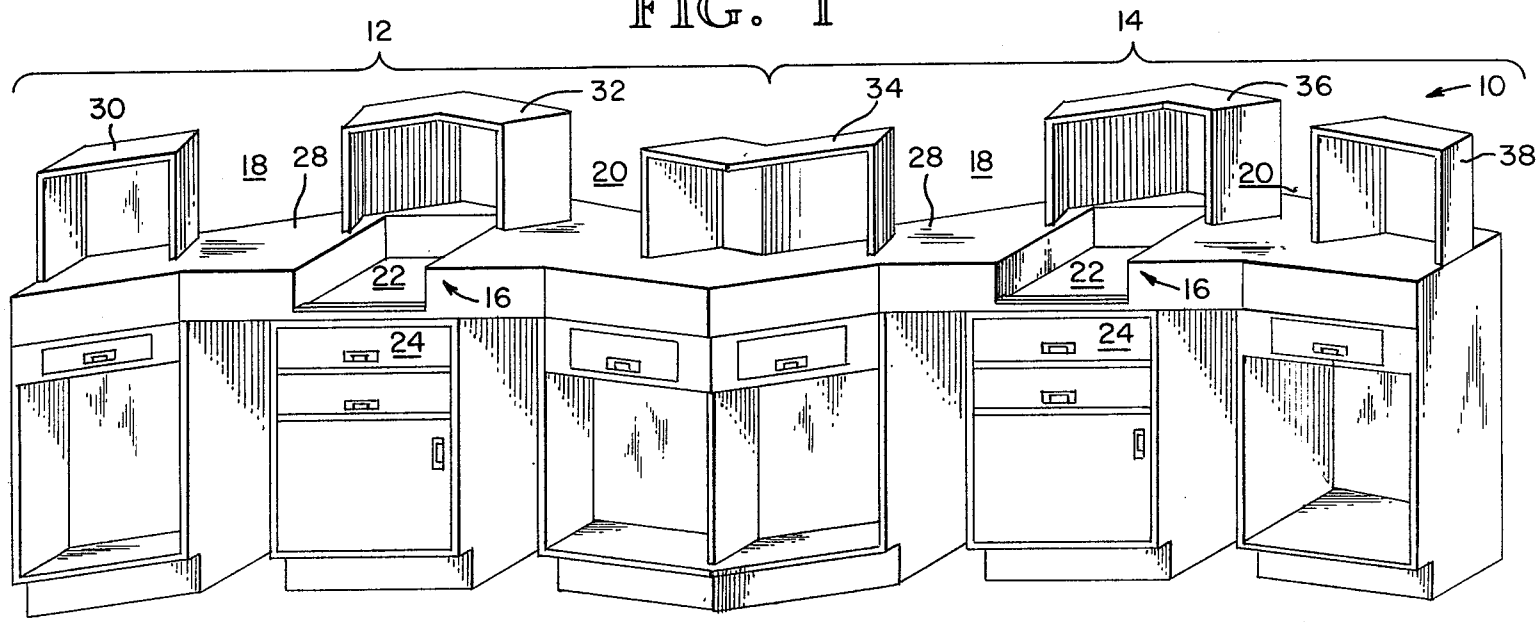
FIG. 1 is an isometric view of the service counter taken from the teller side.

With reference to FIGS. 1 and 2, the service counter 10 includes a plurality of identical service stations 12,14 arranged in a row. Each of the service stations 12,14 include a workspace for a service person 16 and a pair of service windows 18,20. The service station 16 includes a recessed machine well 22 adapted to receive a machine such as an input terminal connected to a central computer, an accounting machine, a coffer maker or a ticket vending machine. Thus each machine services two service windows. As best illustrated in FIG. 2, the forward edge of the service station projects forwardly in front of the workspace 16 so that the service windows 18,20 face convergingly inward toward the service person behind the workspace 16. This arrangement provides the service person with equal access to the windows 18,20. However, the service windows 20,18 of adjacent service stations 12,14, respectively, face away from each other so that a customer at service window 20 of service station 12 faces away from a customer at service window 18 of service station 14. This provides a relatively high degree of privacy for the customer at window 20 so that the customer at window 18 cannot witness the transaction at window 20 without turning around in an obvious manner.

The service stations are interconnected by a continuous horizontal counter 28 having a plurality of dividers 30–38, which have the dual function of privacy barriers and storage areas, projecting upwardly and having a forward edge corresponding in angular configuration to the forward edge of the counter 28. The service windows 18,20 of service stations 12,14 are thus formed by the spacing between the dividers 32,30; 32,34; 36,34; and 36,38, respectively. The dividers 30–38 also increase the privacy afforded to customers since, for example, divider 34 obstructs the view of a customer at window 18 of service station 14 from the transaction of a customer at window 20 of service station 12. Also, divider 32 obstructs the view of a customer at window 18 of each service station from the transaction of a customer at window 20 of the same service station. The dividers 32,36 prevent customer access to the workspaces 16, and the dividers 30,34,38 prevent customer access to the portion of the counter 28 behind the dividers 30,34,38. If desired, the counter area behind the dividers 30,34,38 may have a machine which is accessible to service personnel from the service stations on either side of the area.

Figure 3:
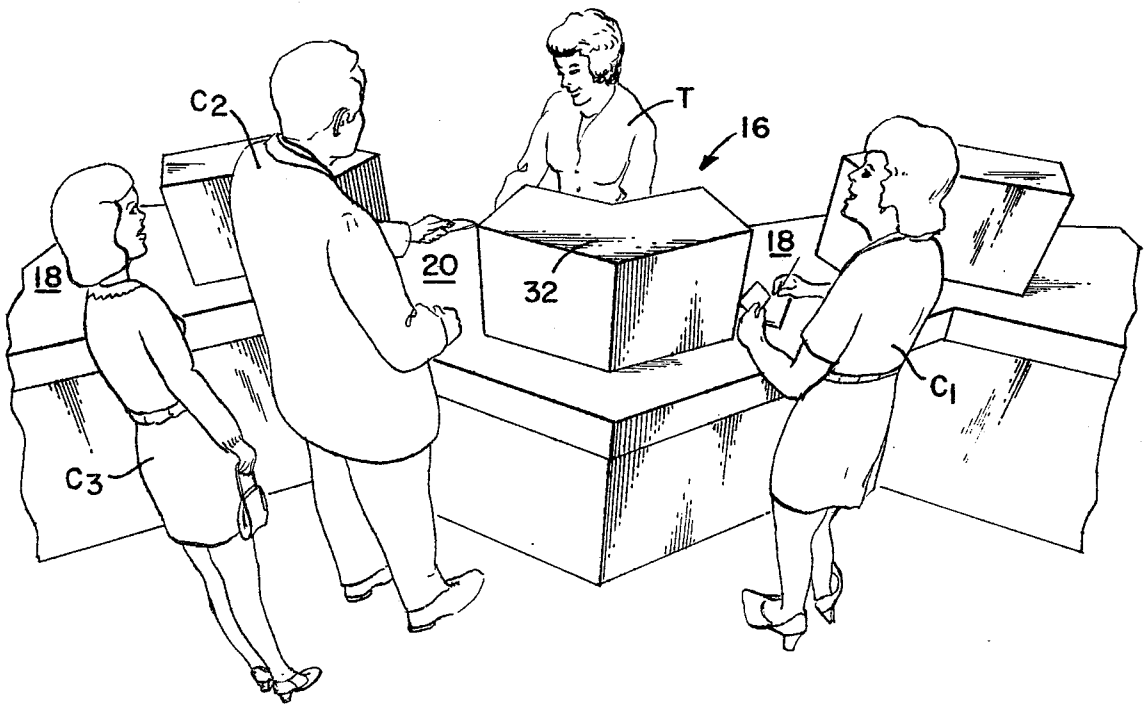
FIG. 3 is an isometric view showing a single service station of the service counter of FIGS. 1 and 2 with a customer at each service area.

The service counter is illustrated in use in FIG. 3. A pair of customers C1,C2 are positioned in front of customer windows 18,20, respectively, with the customer C2 engaging in a transaction with the service person T, and the customer C1 preparing to engage in a transaction with the service person T. When the customer C2 has completed his transaction with the person T, the person T can immediately turn to the customer C1 at the window 18 since the customer C1 and C2 are equally accessible to the person T. When the person T is servicing customer C1, a new customer can go to window 20 so that when the person T finishes her transaction with the customer C1, she can immediately turn to the new customer at window 20. Thus, it is not necessary for the service person and the equipment at the workspace 16 to be idle while one of the customers is preparing for a transaction. Consequently, service and equipment efficiency is relatively high when compared with conventional service counters. Furthermore, a customer C3 at customer window 18 faces away from the customer C2 at window 20 so that it is relatively difficult for the customer C3 to witness the transaction of the customer C2. At the same time, the divider 32 provides privacy from the customer C1 at the window 18.

Figure 4:
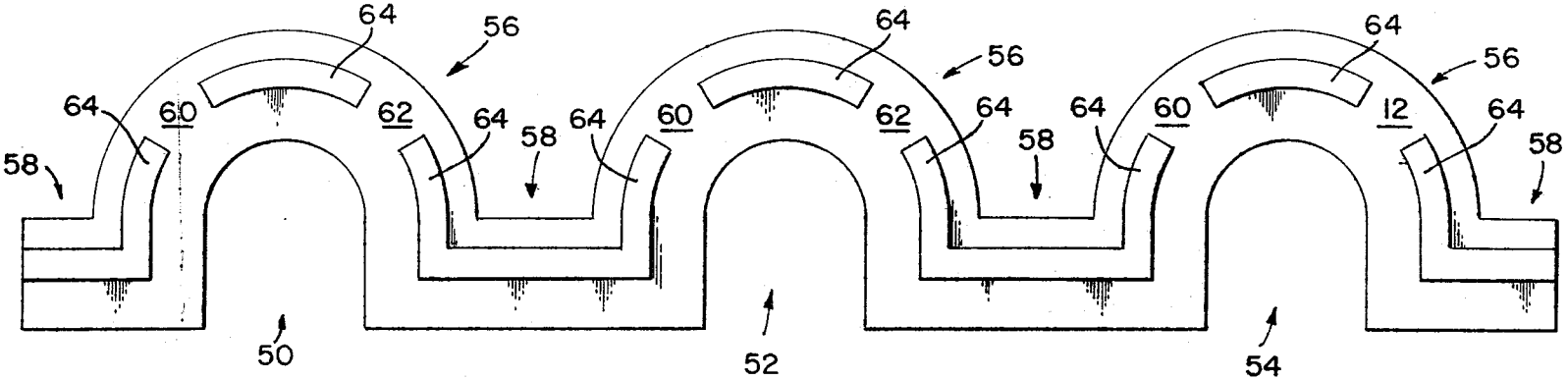
FIG. 4 is a top plan view of an alternate embodiment of the service counter.

An alternative embodiment of the service counter is illustrated in FIG. 4. Each of the service stations 50,52,54 includes a semi-circular counter 56 enclosing a service person (not shown) and a linear portion 58 connecting adjacent service stations. A pair of customer windows 60,62 are formed by spaced apart portions of a continuous divider 64 extending between adjacent service stations which provides access to customers through the customer windows 60,62 but prevents customer access to the area behind the dividers 64. As with the embodiment of FIGS. 1–3, the service counter of FIG. 4 utilizes a single relatively expensive machine for two customer windows, and it simultaneously provides a person with equal access to two customers while providing customers at adjacent customer windows of different service stations a high degree of privacy.

The embodiments of the invention in which a particular property or privilege is claimed are defined as follows:

1. A service counter comprising a plurality of spaced apart, interconnected service stations delineating a customer area on one side of said counter and a service personnel area on the other side of the counter, each of said service stations including a pair of service areas spaced apart by a workspace and a barrier for physically separating said service areas from each other, the service areas for each service station facing toward said workspace such that a service person adjacent said workspace is equally accessible to customers at both service areas of a service station, while adjacent customers at different service stations face away from each other and adjacent customers at the same service station are separated from each other by said barrier.

2. The service counter of claim 1, wherein said service stations extend along a linear axis access with the forward periphery of each service station having a pair of linear portions inclined rearwardly from an apex positioned directly in front of said workspace.

3. The service counter of claim 2, wherein the rear periphery of each service station includes a pair of linear portions extending rearwardly from said workspace separated by a linear portion extending parallel to said axis and centered at said workspace such that the maximum width of said counter is at said workspace.

4. The service counter of claim 1, wherein said service counter includes a plurality of semi-circular sections and a connecting section extending between the ends of adjacent semi-circular sections, each of said semi-circular sections having a pair of said service areas facing away from each other toward a workspace formed behind said connecting section such that adjacent halves of adjacent semi-circular sections and the connecting section extending therebetween form said service stations.

5. The service counter of claim 4, wherein the hemispherical portions of adjacent service stations are separated by linear portions connected to the ends of said hemispherical portions.

6. The service counter of claim 1, wherein each of said service stations is formed by a horizontal counter positioned above a vertical pedestal extending continuously between the service stations of said service counter, each of said service stations further including a first divider extending upwardly from said counter directly in front of said workspace.

7. The service counter of claim 6, further including a plurality of dividers extending upwardly from said counter, said dividers being spaced apart from said first divider and each other by said service areas, the dividers of one service station contacting the dividers of adjacent service stations such that dividers form a continuous barrier projecting above said counter having an aperture positioned at each service area thereby preventing customer access to the major portion of said counter behind said dividers while allowing a person to service customers through said aperture.

8. A service counter comprising a plurality of interconnected service stations delineating a customer area on one side of said counter and a service personnel area on the other side of said counter, each of said service stations including a machine area and a pair of service areas on opposite sides of said machine area spaced apart from each other by a divider, said service areas being equally accessible to a service person positioned adjacent said machine such that a single machine located at said machine area is able to simultaneously service two discrete service areas.

9. The service counter of claim 8, further including a pair of machine stations positioned at the opposite side of each service area from said machine area the machine stations of each service station being common to the machine stations of adjacent service stations.

10. The service counter of claim 8, wherein the service areas for each service station face inwardly toward said machine area such that a person at said machine area is equally accessible to customers at all service areas of a service station, while adjacent customers at different service stations face away from each other.

* * * * *